US005310374A

United States Patent [19]

Tomoyuki

[11] Patent Number: 5,310,374

[45] Date of Patent: May 10, 1994

[54] ELECTRIC LAMP WITH FOIL SEAL CONSTRUCTION AND METHOD OF PRODUCING THE SAME

[75] Inventor: Akio Tomoyuki, Himeji, Japan

[73] Assignee: Ushiodenki Kabushiki Kaisha, Tokyo, Japan

[21] Appl. No.: 111,761

[22] Filed: Aug. 25, 1993

Related U.S. Application Data

[62] Division of Ser. No. 806,337, Dec. 13, 1991, abandoned.

[30] Foreign Application Priority Data

Dec. 25, 1990 [JP] Japan ..... 2-412943

[51] Int. Cl.[5] ..... H01J 9/32

[52] U.S. Cl. ..... 445/27; 445/43; 313/623

[58] Field of Search ..... 445/27, 43; 313/623, 313/624, 625

[56] References Cited

U.S. PATENT DOCUMENTS 3,211,826 3/1961 Holcomb .
3,973,975 8/1976 Francel et al. ..... 106/53
4,522,925 6/1985 Pirooz ..... 501/15
4,677,338 6/1987 Dixon ..... 313/623
4,766,346 8/1988 Weiss ..... 313/623 X
4,835,439 5/1989 Essock et al. ..... 313/332

FOREIGN PATENT DOCUMENTS 0309749 4/1989 European Pat. Off. .

*Primary Examiner*—Kenneth J. Ramsey
*Attorney, Agent, or Firm*—Keck, Mahin & Cate

[57] ABSTRACT

The temperature in the sealed region of an electric lamp with a foil seal arrangement rises when the lamp is illuminated and the foil will oxidize due to the oxygen contained in the air if inappropriately protected. The oxidation leads to premature cracking in the foil, which renders further use of the lamp impossible. To prevent the foil from cracking due to oxidation and to permit the manufacture of a lamp with a long life, the foil is covered with lead oxide. For coating the foil with lead oxide, use is made of an aqueous solution of a lead compound, which decomposes on heating and produces lead oxide.

5 Claims, 3 Drawing Sheets

ELECTRIC LAMP WITH FOIL SEAL CONSTRUCTION AND METHOD OF PRODUCING THE SAME

This is a divisional of application Ser. No. 07/806,337 filed on Dec. 13, 1991, now abandoned.

BACKGROUND OF THE INVENTION

1. Field of the Invention

The invention relates to an electric lamp with a hermetically closed sealing region incorporating a molybdenum foil and to a method for its manufacture.

2. Background of the Disclosure

For the hermetic sealing of the quartz glass bulb of an incandescent lamp or a discharge lamp, it is generally known to use a metal foil seal.

For example, FIG. 1 shows a tungsten halogen lamp. Molybdenum foils 2 are inserted in the sealed pinched base regions 3, which are formed at both ends of the lamp 10. To each of the outside edges of the molybdenum foils 2 is soldered a cap pin 4 as an outer lead which extends outward from the cap or end face 3*a* of the base region 3. In an envelope 1 is located a filament 5, whose two ends are connected by means of inner leads 6 to the inner edges of the molybdenum foils 2.

FIG. 2 is a larger-scale view of one of the sealed base regions 3 of the lamp 10. From the outer end or face 3*a* of the sealed base region 3 to the outer edge or end of the molybdenum foil 2, a microscopically small cavity G extends around the cap pin 4. This cavity is formed, in any event, as a result of the different thermal expansion coefficients between the quartz glass from which the envelope 1 is made and the material of the cap pin 4. Therefore, it is not possible to prevent the formation of such cavity G.

Air, including oxygen, passes into the aforementioned cavity G around the cap pin 4. As noted, the cavity extends from the outer end 3*a* of the sealed base region 3 to the outer end of the molybdenum foil 2. Oxygen speeds up the oxidation of the molybdenum foil 2. This oxidation leads to premature cracking of the molybdenum foil 2, which shortens the life of the lamp 10. Such oxidation in particular becomes a problem, if the sealed base region temperature rises above 350° C.

Illustrated in FIG. 3 is a hitherto adopted solution for eliminating the aforementioned deficiency. The cap pin 4 at the outer end 3*a* in the sealed base region 3 is smeared with a tacky, vitreous material 15. This tacky, material 15 is formed by glass powder having a low melting point. The vitreous material 15, which is subsequently melted by heating, seals the opening of the cavity G.

U.S. Pat. No. 4,835,439 describes an arrangement of a sealed base region, in which a solution of alkali metal silicate is injected into the cavity G in order to eliminate the aforementioned deficiency.

In the previously described arrangement of the sealed base region, in which the opening of the cavity G is sealed with the low melting point vitreous material 15, it would appear to be disadvantageous that when switching on the lamp, the vitreous material melts, and then solidifies when switching the lamp off. The melting and resolidification of the vitreous material leads to the formation of numerous small cracks, which, when the lamp is switched off, allow the air to penetrate into the cavity G. Thus, the hitherto provided vitreous material has not been sufficiently effective for sealing the cavity G, and consequently, a long lamp life does not result therefrom. It is also difficult, due to the tackiness of the vitreous material 15, to automate the smearing process.

The alkali metal silicate solution described in U.S. Pat. No. 4,835,439 can be relatively easily injected into the cavity G, due to its good flow behavior. However, if the temperature rises above 350° C., as stated, the oxidation prevention obtained is not adequate. Another disadvantage is that it takes a relatively long time for the filled solution to dry and harden.

SUMMARY OF THE INVENTION

The present invention has been based on the aforementioned facts. The first object of the invention is to provide a lamp with a foil seal arrangement, which has in the sealed area an incorporated molybdenum foil, and which is characterized by a long life.

A further object of the invention is to provide a simple method for the manufacture of an electric lamp with the novel foil seal arrangement.

According to the invention this object is achieved by providing an electric lamp comprising a filament or an electrode and an envelope: The ends of the envelope are sealed with a foil seal arrangement. A molybdenum foil is incorporated into the sealed region and is connected to an outer lead. The surface of the molybdenum foil, in the sealed region, is coated with lead oxide or with a sealing material whose main constituent is lead oxide. As noted, the sealed region will have a microscopically small cavity, which extends from the outer end face of the sealed region along the outer lead to the outer end or edge of the molybdenum foil.

With respect to the manufacturing method for the electric lamp with the foil seal arrangement, according to the invention this object is achieved by the step of inserting a molybdenum foil in the sealed region of the envelope, connecting to an outer lead, and injecting a sealing solution, resulting from the dissolving of a sealing compound or composition into the microscopically small cavity extending along the outer lead up to the outer end of the molybdenum foil. The sealing compound is lead oxide or a material, whose main constituent is lead oxide, or a material from which lead oxide is produced by the thermal decomposition of the sealing material or compound.

The effect of the invention is that the electric lamp with the foil seal arrangement is characterized by a surface coating of the molybdenum foil, which is exposed to the cavity along the outer lead in the sealed region, and thus this surface coating essentially of lead oxide prevents oxidation of the molybdenum foil.

The sealing solution used in the present invention can easily be introduced into the cavity extending along the outer lead, conductor, wire or terminal in the sealed region due to its high fluidity, i.e. low viscosity, which simplifies the manufacture of an electric lamp with a foil seal arrangement and results in ready attainment of the desired rating.

DETAILED DESCRIPTION OF PREFERRED EMBODIMENTS

The invention will now be specifically described with reference to preferred embodiments.

Figure 1:
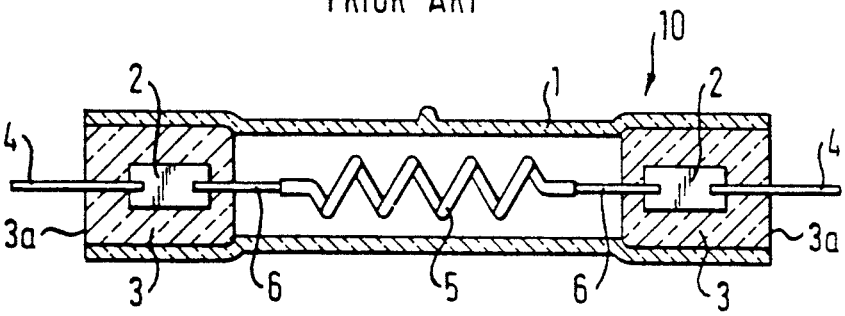
Fig. 1 PRIOR ART
FIG. 1 Diagrammatically shows a view of an incandescent halogen lamp, according to the prior art.
Figure 2:
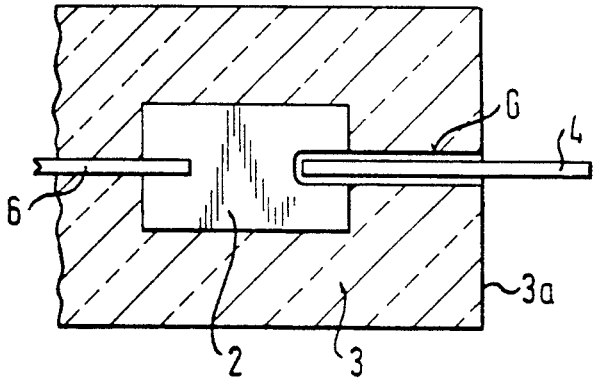
Fig. 2 PRIOR ART
FIG. 2 Diagrammatically shows on a larger scale, a cross-section through a sealed region of the incandescent halogen lamp according to FIG. 1.
Figure 3:
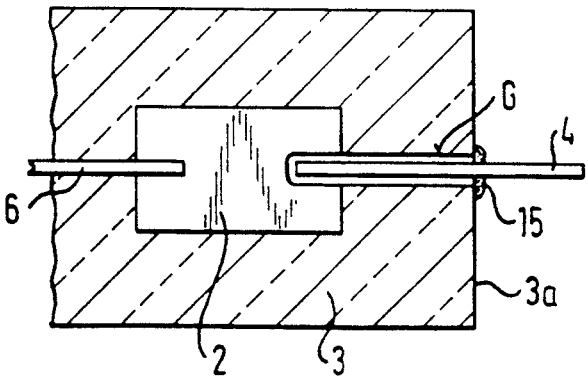
Fig. 3 PRIOR ART
FIG. 3 Diagrammatically shows a cross-section through a sealed region of an incandescent halogen lamp with a conventional seal according to the prior art.
Figure 4:
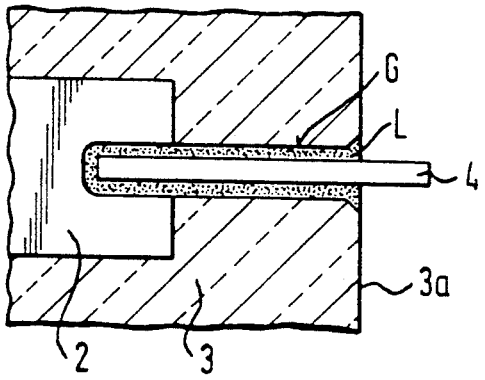
FIG. 4 Diagrammatically shows on a larger scale a cross-sectional view of the sealed region on the end of an incandescent halogen lamp illustrating the manufacturing method according to the present invention.

An example of the electric lamp according to the invention is shown in FIG. 4 and comprises a quartz glass envelope 21 with sealed regions 3. In each sealed region 3 is incorporated a molybdenum foil 2 to which is connected an outer lead 4. The surface of the molybdenum foil 2, which is exposed to a cavity G extending along the outer lead 4 is covered with lead oxide or a sealing material, whose main constituent is lead oxide. The above-described electric lamp with the novel foil seal arrangement is manufactured in the following way.

By dissolving a preselected sealing compound in a suitable solvent, a sealing solution is obtained, which upon heating will thermally decompose to generate lead oxide or a sealing material whose main constituent is lead oxide. As shown in FIG. 4, a small amount of the sealing solution L is injected into cavity G by means of a suitable syringe. The sealing solution enters cavity G at the outer face or end 3*a* along the outer lead 4. Due to its highly liquid nature, low viscosity, the sealing solution L flows extremely smoothly into the cavity G, which, without the aid of a special means or appliance, other than the syringe, will be completely filled with the sealing solution L.

Figure 5:
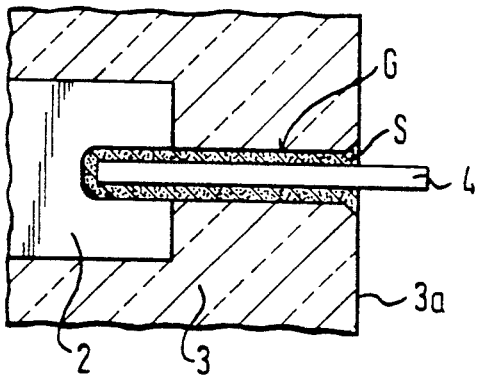
FIG. 5 Diagrammatically shows on a larger scale a cross-sectional view of the covered foil and outer lead according to the present invention.

After the sealing solution has been injected in this way into the cavity G of the sealed region 3 and has dried, the sealed region 3 is heated to 500° C. for example, or such other appropriate temperature to decompose the sealing compound and produce a lead oxide coating of foil 2 and lead 4 by thermal decomposition of the sealing compound. The sealing material S, whose main constituent is lead oxide covers the surface of the molybdenum foil 2 and lead 4 which are exposed in the cavity G, as shown in FIG. 5.

Suitable examples of the sealing compound are lead nitrate and lead acetate. Due to the high solubility of these sealing compounds in water, the water can be used, and is preferred, as the solvent for the sealing solution. Other solvents for lead nitrate and lead acetate may also be used. If water is used as the solvent, the water can e.g. contain a little alcohol, which further improves the flow behavior of the sealing solution. If as the sealing solution L, use is made of an aqueous solution of lead nitrate or lead acetate, the desired concentration is $\geqq 0.2$ mole/liter. With a concentration lower than 0.2 mole/l of the aqueous solution, the lead oxide covering is, in many cases, not thick enough to effectively prevent oxidation. The aqueous solution can also be saturated.

Alkali metal salt or/and boric acid or/and a metaboric acid can also be added as an addition in the above-described sealing solution L when it is an aqueous solution of lead nitrate or lead acetate. This additional material easily dissolves in the aqueous lead nitrate or lead acetate solution without increasing the viscosity, so that the sealing solution L can be uniformly and easily introduced into the cavity G of the sealed region. The sealing material S formed of lead oxide, generated from the aqueous solution of the lead nitrate or lead acetate, contains as a residual trace the constituent alkali metal salt or boric acid or metaboric acid, so that the effect of covering the molybdenum foil exposed in the cavity G is increased.

As a suitable alkali metal salt, water-soluble salt like nitrate, hydroxide, chloride or carbonate of alkali metal e.g. lithium, sodium or potassium, can be used. The desired ratio between the addition of the aforementioned additional material to the sealing solution in the present invention is 1 mole of lead (Pb) contained in the sealing solution to $\leqq 0.12$ mole of alkali metal salt or $\leqq 0.02$ mole of boric acid or metaboric acid. If the additional material proportion in the sealing solution is excessive, there is a risk of etching of the molybdenum foil.

Dye can also be dissolved in the aforementioned inventive sealing solution. In the sealing solution, comprising the aqueous solution of lead nitrate or lead acetate, one can use a water-soluble dye, e.g. amaranth (red), indigo carmine (blue), acid violet 6 B (violet) or rodamine B (light red). The sealing solution with a dye can be visually detected through the color, which makes it possible to easily identify visually the cavity filling level resulting from the injection of the aforementioned sealing solution and to inspect the integrity.

Due to the highly fluid nature of the aforementioned sealing solution, the solution can easily be injected into the cavity with a syringe or introduced by a glass rod.

Figure 6:
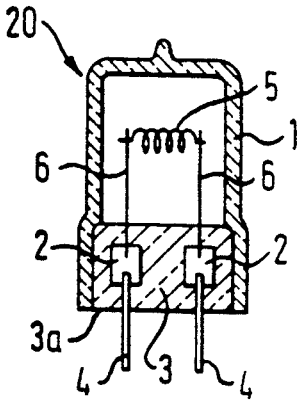
FIG. 6 Shows a diagrammatic view of another type of lamp incorporating the present invention.
Figure 7:
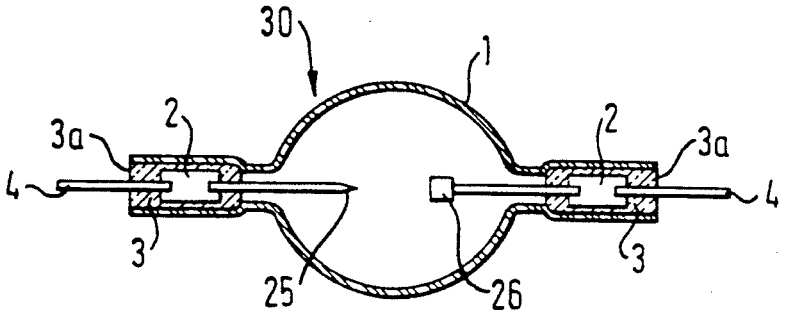
FIG. 7 Diagrammatically shows a view of a discharge lamp using the present invention.

The lamp to which the aforementioned embodiments refer is an incandescent lamp provided with an envelope having a sealed region at both ends. However, the present invention can also be used in the case of a lamp with a different construction, provided that it has a sealed region in which is incorporated a molybdenum foil. As shown in FIG. 6, the invention can be used in the case of a lamp 20, which comprises an envelope 21, which is provided at one end with a sealed region 3 in which are incorporated two or more molybdenum foils 2. However, as shown in FIG. 7, the invention can also be used with a discharge lamp 30, which has a spherical envelope 31, which comprises two outer leads 4 connected to the opposite outer ends of the molybdenum foils 2 and a discharge electrode 25, as well as a discharge electrode 26. In FIG. 6, the filament is 5 and the inner lead is 6.

Embodiments of the invention are further illustrated hereinafter.

Example 1

Preparation of the sealing solution

The following sealing solutions 1 to 6 were prepared from the following materials in each case dissolved in water, and incorporating the red, water-soluble dye amaranth:

| | | |
|---|---|---|
| Sealing solution 1: | lead nitrate | 0.5 mole/l |
| Sealing solution 2: | lead nitrate | 0.5 mole/l |
| | potassium nitrate | 0.01 mole/l |
| Sealing solution 3: | lead nitrate | 0.5 mole/l |
| | potassium nitrate | 0.01 mole/l |
| | boric acid | 0.003 mole/l |
| Sealing solution 4: | lead acetate | 0.3 mole/l |
| Sealing solution 5: | lead acetate | 0.3 mole/l |
| | potassium acetate | 0.01 mole/l |
| Sealing solution 6: | lead acetate | 0.3 mole/l |
| | potassium acetate | 0.01 mole/l |
| | metaboric acid | 0.003 mole/l |

Manufacturing method for a lamp with a foil seal arrangement

Incandescent lamp types having one or more sealed regions each incorporating a molybdenum foil were assembled by conventional and known manufacturing steps. The aforementioned sealing solutions 1 to 6 were injected with a syringe around the outer lead in each sealed region. It was confirmed visually that the injected sealing solution flowed smoothly into the cavity and filled the entire cavity area. Subsequently, the aforementioned sealed regions containing the sealing solutions were dried and heated and the sealing materials thermally decomposed in a furnace at 500° C. The water-soluble dye decomposed and the color of the sealing solutions disappeared.

Burning period test

The lamps 1 to 6 of each type (cf. table 1) treated in the aforementioned manner with the sealing solutions 1 to 6 underwent a series of durability or life tests under different conditions. For comparison purposes use was also made of lamps, in which the openings of the cavity in the sealed region were not obstructed (filled), lamps using as the sealing compound low melting point glass; and lamps in which the sealing compound was constituted by an aqueous potassium silicate solution. All lamps underwent the same tests.

The details of the lamp types used for the burning period tests and the conditions under which lighting took place are as follows:

Lamp type

DYS: a lamp of the same construction as Ushio ordering code JCD 120 V/600 WC, one-sided cap, circular bulb and rated consumption 600 W.

DXW: a lamp of the same construction as Ushio ordering code JPD 230 V/1000 $WC_5$, two-sided cap, rod-like tubular bulb and rated consumption 1 kW.

FCR: a lamp of the same construction as Ushio ordering code JC 12 V-100 W. One-sided cap, rod-like tubular bulb and rated consumption 100 W.

H3: a lamp of the same construction as Ushio ordering code JA 12 V-55 W, particularly developed for cars, one-sided cap, rod-like tubular bulb and rated consumption 55 W.

"One-sided" in this case means a lamp having a bulb, which is provided at one end with a sealed region in which are incorporated two molybdenum foils. "Two-sided" means a lamp having a bulb containing at both ends in each case one sealed region, in which is incorporated a molybdenum foil.

Operating conditions

I. Lamp operated for one hour, then switched off, followed by a 30 minute pause. This process is repeated in a lamp house.

II. Uninterrupted testing at 600° C. in an electric furnace.

III. Uninterrupted testing at 500° C. in an electric furnace.

The results are given in table 1 on the last page of this detailed description.

The figures in the table mean the time up to which the foil cracked due to oxidation. "180 or more", "220 or more" and "440 or more" mean that the molybdenum foil of the particular lamp did not suffer cracking by oxidation after an illuminated period of 180, 220 and 440 hours, respectively, but the lamp was unusable for some other reason. It follows from table 1 that under illumination conditions I, II and III the invention is superior to the prior art, with conditions II and III revealing a marked superiority.

Example 2

Figure 8:
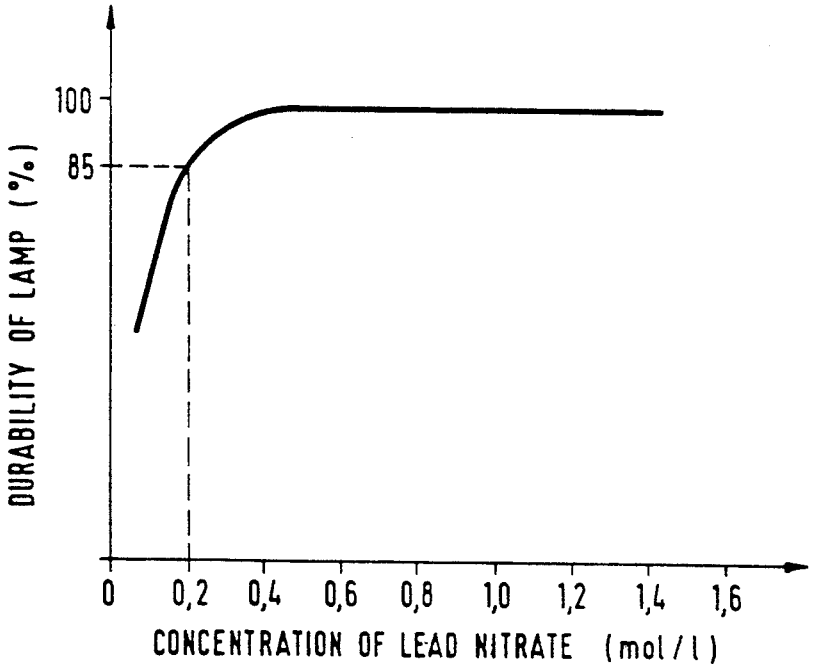
FIG. 8 Graphically shows the relationship between the lead nitrate concentration of a sealing solution and the life of an electric lamp with a foil seal arrangement having lead oxide derived from the lead nitrate sealing solution.

Aqueous lead nitrate solutions were prepared with different concentrations. Each individual solution was used in the same way as in test A of example 1 for treating the sealed region of a lamp with a foil seal arrangement (lamp type DYS) for obstruction purposes. Tests were carried out under the operating condition I. The ratio to be determined by the aforementioned test between the lead nitrate concentration in the sealing solution used and the life of the lamp is shown by the course of the curve in FIG. 8. On the ordinate axis is plotted in percentage form the quotient of the projected desired life of the filament as the denominator and the lighting time as the numerator until the particular lamp could no longer be used due to foil cracking. 100% e.g. means that during the illuminations the foil did not crack by the time the desired filament life was reached. 50% e.g. means that during the illumination cracking occurred on the foil after only half the desired filament life was reached. FIG. 8 shows that the weaker the lead nitrate concentration the earlier cracking occurs in the foil. As mentioned above, the reason for this is that in the case of a weak concentration the thickness of the lead oxide covering is thin and then not adequate to effectively prevent oxidation. It follows from FIG. 8 that a sufficiently long lamp life is obtained if the lead nitrate concentration in the sealing solution is $\geqq 0.2$ mole/l.

The Effect of the Invention

In the present invention, the exposed foil and lead are covered with lead oxide or with a sealing amterial whose main constituent is lead oxide. This increases the corrosion resistance of the molybdenum foil, and consequently, adequately prevents the foil from oxidation by oxygen in the air. Thus, the present invention provides an electric lamp with a foil seal arrangement, which has a long life. Due to its low viscosity, the inventively used sealing solution easily penetrates into the cavity along the outer lead in the sealed region, which facilitates sealing solution injection and adequately supports the automation of the operation. Thus, the present invention provides a simple manufacturing method for an electric lamp with a foil seal arrangement, which has a long life.

Although the present invention has been shown and described with reference to preferred embodiments, changes and modifications are possible to those skilled in the art which do not depart from the spirit and contemplation of the inventive concepts taught herein. Such are deemed to fall within the purview of the invention as claimed.

TABLE 1

| subjected to a treatment | | test A | test B | test C | test D | test E |
|---|---|---|---|---|---|---|
| Lamp type | | DYS | DXW | FCR | H3 | FCR |
| Operating conditions | | I | I | II | II | III |
| Test series | solution 1 | 30 | 38 | 220 or more | 440 or more | 180 or more |
| | solution 2 | 47 | 51 | 220 or more | 440 or more | 180 or more |
| | solution 3 | 50 | 53 | 220 or more | 440 or more | 180 or more |
| | solution 4 | 31 | — | 220 or more | — | 180 or more |
| | solution 5 | 42 | — | 220 or more | — | 180 or more |
| | solution 6 | 44 | — | 220 or more | — | 180 or more |
| Comparison tests | the opening of the cavity is not obstructed | 4.9 | 7.1 | — | 3.1 | 11.8 |
| | Glass with a low melting point | 25 | 34 | — | — | 180 or more |
| | Potassium silicate | 12.0 | 14.9 | 16.0 | 300 | 80 |

What we claim is:

1. A manufacturing method for an electric lamp having an envelope with a foil seal arrangement incorporating a molybdenum foil and to which is connected an outer lead and which is characterized by a microscopically small cavity surrounding the outer lead and the area of connection between the outer lead and foil, including the steps of injecting a sealing solution containing a sealing compound from which lead oxide can be obtained by thermal decomposition into the microscopically small cavity, and thermally decomposing the sealing compound to coat lead oxide on the outer end of the molybdenum foil.

2. A manufacturing method according to claim 1, wherein the sealing solution is an aqueous solution of lead nitrate or lead acetate, with a concentration $\geqq 0.2$ mole/l.

3. A manufacturing method according to claim 2, wherein the sealing solution contains alkali metal salt, in a molar ratio $\leqq 12\%$ to the lead content of the solution.

4. A manufacturing method according to claim 2, wherein the sealing solution contains boric or metaboric acid, in a molar ratio of $\leqq 2\%$ to the lead content of the solution.

5. A manufacturing method according to claim 2, wherein the sealing solution contains a dye.

* * * * *